United States Patent [19]

Wallace et al.

[11] Patent Number: 4,516,100

[45] Date of Patent: May 7, 1985

[54] MECHANICAL INTERLOCK FOR VERTICALLY MOUNTED CIRCUIT BREAKERS

[75] Inventors: James B. Wallace, Sarasota, Fla.; Glenn R. Thomas, Brighton, Pa.

[73] Assignee: Westinghouse Electric Corp., Pittsburgh, Pa.

[21] Appl. No.: 562,502

[22] Filed: Dec. 16, 1983

[51] Int. Cl.[3] ..... H01H 33/46

[52] U.S. Cl. ..... 335/160; 200/150 C; 335/161

[58] Field of Search ..... 335/160, 161; 200/150 C

[56] References Cited

U.S. PATENT DOCUMENTS 4,286,242 8/1981 Mrenna et al. ..... 335/160

*Primary Examiner*—Harold Broome

*Attorney, Agent, or Firm*—John V. Pezdek

[57] ABSTRACT

A mechanical interlock for a pair of vertically mounted circuit breakers, each circuit breaker having a trip latch mechanism for opening the circuit breaker and a mechanical contact position indicator for indicating the open or closed position of the circuit breaker with the interlock extending between the trip latch mechanism and contact position indicator mechanism of each circuit breaker. The interlock allowing only one circuit breaker to be closed at any time.

7 Claims, 3 Drawing Figures

MECHANICAL INTERLOCK FOR VERTICALLY MOUNTED CIRCUIT BREAKERS

BACKGROUND OF THE INVENTION

This invention is related to mechanical interlocks between a pair of vertically mounted circuit breakers for preventing one of the circuit breakers from closing when the other circuit breaker is closed.

The control of electrical systems including such devices as reversible motors and multispeed motors usually utilizes a circuit breaker for each motor function. A typical circuit includes, for example, a separate manual button for each circuit breaker for the forward and reverse directions of the motor and for each speed of a multispeed motor. For example, for a reversing motor the control circuit involved for the forward speed and for the reverse speed would be electrically interlocked such that both circuits could not simultaneously be energized. Notwithstanding such precautions, however, it sometimes occurs due to inadvertence or other reasons that both control circuits (i.e. forward and reverse) are actuated simultaneously and thereby cause incorrect phase-to-phase line connections. Another typical circuit involves transfer circuits with normal and emergency sources for which one circuit breaker must be prevented from closing when the other breaker is closed. Thus, there is a need for a mechanical as well as electrical interlocking between the two circuit breakers.

Various interlock devices had been provided for overcoming the problem of simultaneous actuation of circuit interrupters. However, most of such interlocks have not been completely satisfactory for various reasons. An example of a mechanical interlock is set forth in U.S. Pat. No. 4,286,242, issued Aug. 25, 1981 entitled "Mechanical Interlock for Low Voltage Circuit Breaker" and assigned to the assignee of the present invention. However one disadvantage of this interlock is that it is primarily utilized for side-by-side mounting of circuit breakers and is not readily adaptable for vertically mounted circuit breakers now found in most multi-speed or reversing motor applications.

SUMMARY OF THE INVENTION

The present invention is embodied in a mechanical interlock mechanism for preventing a pair of vertically mounted circuit breakers from being concurrently closed. Each circuit breaker includes a trip latch mechanism operable between tripped and untripped positions that when tripped opens the circuit breaker when closed and prevents closing thereof and when untripped allows the circuit breaker when open to be closed. Also included with each circuit breaker is a contact position indicator mechanism for providing mechanical indication of the open and closed position of the circuit breaker.

The interlock mechanism comprises four bell crank assemblies. Each bell crank assembly includes a rod having two axially offset radial arms positioned substantially perpendicular with respect to each other and brackets for supporting the rod and allowing the rotation thereof about an axis defined by a center line through the length of the rod. The first and second bell crank assemblies are mounted adjacent the first or upper circuit breaker with the third and fourth bell crank assemblies mounted adjacent to the second or lowr circuit breaker. The rods of the first and third bell crank assemblies are positioned substantially parallel to one another and each have one arm being in corresponding radial and vertical alignment. The other arm of the first bell crank assembly connects to the contact position indicator mechanism of the upper circuit breaker. The arrangement of the fourth and second bell crank assemblies is substantially similar to that of the first and third bell crank assemblies, respectively. A pair of bell crank assembly intraconnecting rods are provided to connect correspondingly aligned arms of the first and third bell crank assemblies and the second and fourth bell crank assemblies, respectively. A pair of trip latch connecting rods are used to connect the trip latch mechanism of each circuit breaker with the interlock mechanism. One trip latch connecting rod is connected to the trip latch mechanism of the first circuit breaker and the other arm of the second bell crank assembly with the other trip latch connecting rod connected to the trip latch mechanism of the second circuit breaker and the other arm of the third bell crank assembly. Trip latch spring biasing is provided for returning each trip latch mechanism to the untripped position.

In operation, the interlock for the first circuit breaker is actuated by the contact position indicating mechanism moving to the closed position. This causes the rotation of the first bell crank assembly via the arm thereof connected to the contact position indicating means. The rotation of the first bell crank assembly moves the bell crank assembly interconnecting rod connected thereto that, in turn, rotates the third bell crank assembly. The rotation of the third bell crank assembly moves the trip latch connecting rod that, in turn, moves the trip latch mechanism of the second circuit breaker to the tripped position preventing the second circuit breaker from closing. Upon opening of the first circuit breaker, the trip latch spring biasing moves the trip latch means of the second second breaker back to the untripped position allowing the second circuit breaker to be closed. The interlock for the second circuit breaker functions in substantially the same manner with the first circuit breaker via the fourth and second bell crank assemblies. With this arrangement only one of the two circuit breakers can be closed at any time.

The advantage of the mechanical interlock of this invention is that the closed breaker must first be opened before the other breaker can be closed. Moreover, the closed circuit breaker holds the trip latch mechanism of the other circuit breaker in the tripped position and while in this position closing of the other circuit breaker cannot occur.

BRIEF DESCRIPTION OF THE DRAWINGS

For a better understanding of the invention reference may be made to the embodiments exemplary of the invention shown in the accompanying drawings wherein.

DETAILED DESCRIPTION

Figure 1:
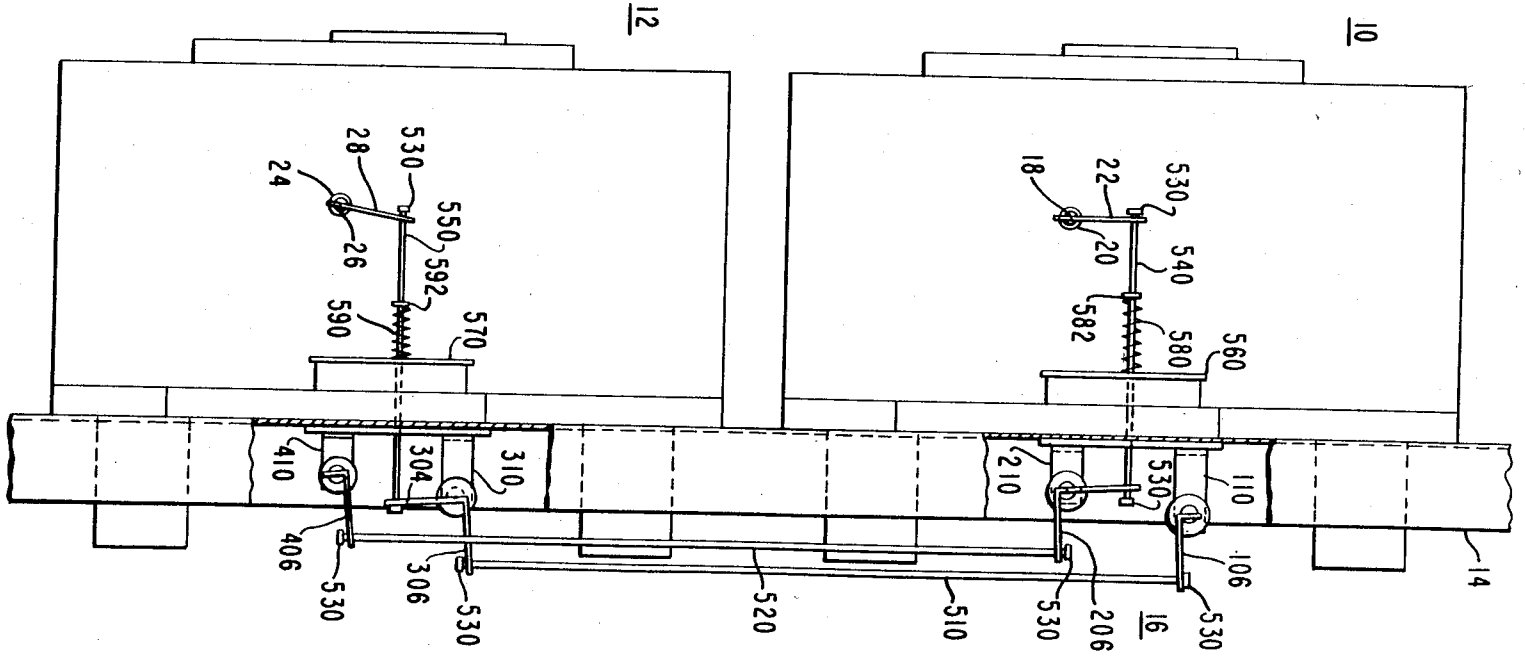
FIG. 1 is an elevation view of a pair of vertically mounted circuit breakers with the interlocking mechanism in accordance with the present invention.

In FIG. 1 a pair of circuit breakers generally indicated at 10 and 12 are vertically mounted in a spaced relation on a support base 14. A mechanical interlock generally indicated at 16 extends between and is operatively connected to the vertically mounted circuit breakers 10 and 12. The circuit breakers are preferably similar in construction and operation and are of the type that is generally disclosed in U.S. Pat. No. 4,114,005 issued Sept. 12, 1978 entitled "Circuit Breaker Spring Assembly" and assigned to the assignee of the present invention. Because of the full disclosure in that patent, the description herein of the circuit breakers is limited to the particular parts necessary to the description of the structure and operation of the present invention.

Included in each circuit breaker is a trip latch mechanism and a contact position indicator mechanism. The trip latch mechanism, responsive to mechanical actuation, is operable between a tripped and untripped position. The trip latch mechanism cooperates with the operating mechanism of the breaker to open the circuit breaker when moved to the tripped position. Further, closing of the circuit breaker is also prevented when the trip latch mechanism is in the tripped position. When the trip mechanism is in the untripped position, the circuit breaker can be opened or closed by the operating mechanism. Only when the trip latch mechanism is in the tripped position will the operating mechanism be prevented from closing an open circuit breaker. An example of a trip latch mechanism which can be used with the interlock mechanism 16 can be found in U.S. Pat. No. 4,286,242 cited previously. Various constructions for the trip latch mechanism can be used. However, for whatever particular construction of trip latch mechanism that is used, the mechanism must be capable of being actuated by the mechanical action provided by the interlock mechanism 16.

For circuit breaker 10 the trip latch mechanism includes the actuating rod 18 extending therefrom and through an opening 20 the side wall of the breaker 10. A radially extending arm 22 is connected to the exterior end of the actuating rod 18. As shown in FIG. 1 the clockwise rotation of the actuating rod 18 about an axis defined by the centerline along the length of the rod 18 will place the trip latch mechanism in the tripped position. Actuating rod 24 extending through opening 26 and having the radial arm 28 serves the corresponding function for the trip latch mechanism of circuit breaker 12. In FIG. 1, breaker 10 is in the untripped position and breaker 12 is in the tripped position.

Figure 3:
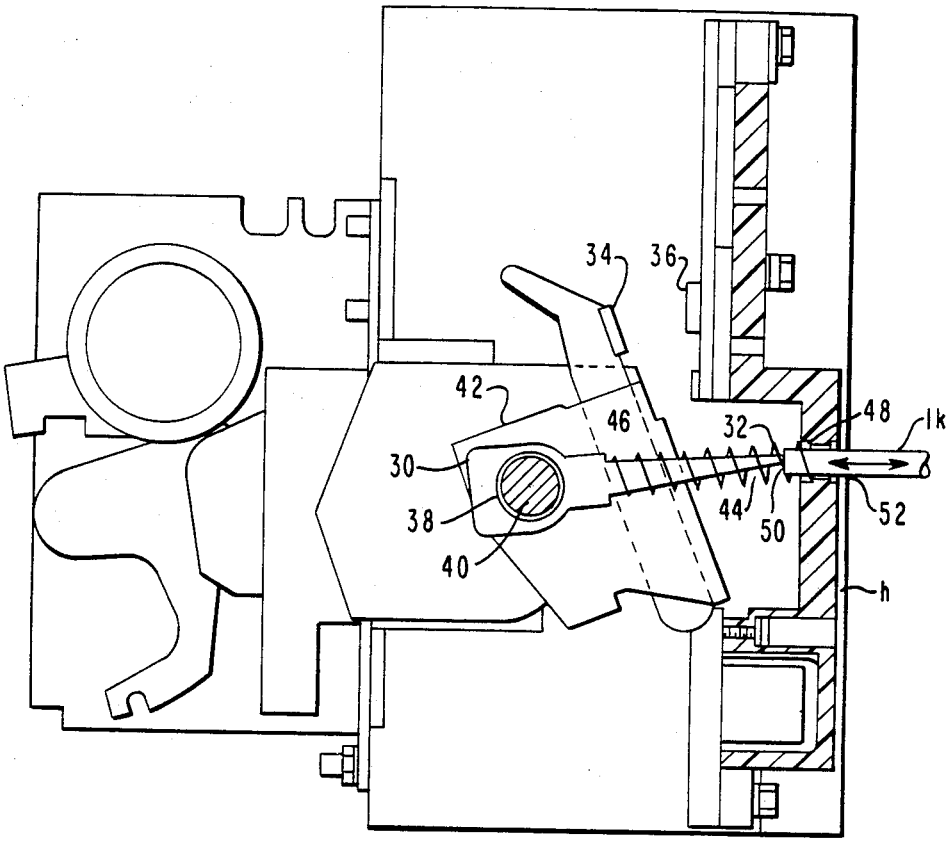
FIG. 3 is a partial elevational view of the upper circuit breakers of FIG. 1 illustrating one of the connections between the circuit breaker and the interlock mechanism embodying the invention.

The contact position indicator mechanically cooperates with the movable contact of the circuit breaker. The contact position indicator is an element in the circuit breaker that changes between two positions that correspond to the open and closed positions of the movable contact and that is or can be made accessible for connection to the interlock mechanism. Referring to FIG. 3, in each circuit breaker this indicator is a spring guide 30, also known as a "lollipop", for the coil-type opening springs 32 which are used to transfer the movable contact 34 from the closed position to the open position with respect to the stationary contact 36. The spring guide 30 has an opening 38 enabling the mounting of the guide 30 about a shaft 40 of the movable contact carrier that is used to align the movable contacts, usually three in number, of the circuit breaker. The contact carrier 42 enables the opening and closing of multiple movable contacts to occur in unison. The spring guide 30 is rotatable about the shaft 40 permitting substantially linear travel for the guide even though the movable contacts travel through an arc. It is this linear travel of the spring guide that serves as the indication of the position of movable contacts.

During closing of the circuit breaker the spring guide 30 moves in the central opening 44 of the coil spring 32 as it is compressed between the shoulders 46 of the spring guide 30 and a spring seat 48 provided in the housing h of each circuit breaker. Upon opening of the circuit breaker the coil spring 32 expands and rapidly drives the movable contact 34 to the open position. This moves the spring guide 30 in a direction opposite to that on closing. This motion of the spring guide 30 is utilized for actuating the interlock mechanism. For each circuit breaker, the contact position indicator mechanism is cooperatively attached with the interlock; preferably by the abutment of the end 50 of the spring guide 30 with an end of the indicator connecting linkage lk that is preferably spring biased and described hereinafter, of the interlock mechanism 16. An opening 52 is provided in the housing h for the passage of the connecting linkage lk. Because the linkage lk also extends into the central opening 44 of the opening spring 32, the spring 32 keeps the end 50 of the spring guide 30 aligned with the end of the linkage lk. By abutting the linkage lk and the spring guide 30, the interlock mechanism can be disconnected from the breaker by the removal of the linkage lk without having to enter into the interior of the circuit breaker housing h. Although abutment of the linkage lk and the spring guide 30 is preferred, other means can be used to effect the mechanical cooperation required between the spring guide, i.e., the contact position indicator and the interlock mechanism 16.

The interlock mechanism 16 comprises four bell crank assemblies 100, 200, 300 and 400. The first bell crank assembly 100 includes a rod 102 having two axially offset radial arms 104 and 106 positioned substantially perpendicular with respect to each other, support brackets 108 and 110 for supporting the rod 102 and allowing the rotation thereof about an axis defined by a center line through the length of the rod 102. The second bell crank assembly 200 includes the rod 202, the axially offset radial arms 204 and 206, the support brackets 208 and 210. The third bell crank assembly 300 includes the rod 302, radial arms 304 and 306 attached thereto and support brackets 308 and 310. The fourth bell crank assembly 400 has the rod 402 with radial arms 404 and 406 along with support brackets 408 and 410. All support brackets are fastened to the support base 14 by conventional fastening such as nuts and bolts (not shown). The amount of axial offset, if any, of the radial arms is determined by the locations of the connection to the contact position indicators and the the trip latch mechanism in each circuit breaker. The radial arms on each rod are substantially perpendicular to each other providing for substantially 90° translation in the direction of motion.

The first and second bell crank assemblies 100 and 200 are mounted adjacent the first or upper circuit breaker 10 with the third and fourth bell crank assemblies 300 and 400 mounted adjacent to the second or lower circuit breaker 12. The rods 102 and 302 of the first and third bell crank assemblies are substantially parallel to one another and have the arms 106 and 306 thereof being in corresponding radial and vertical alignment. The other arm 104 of the first bell crank assembly 100 is connected to the contact position indicator of the upper circuit breaker 10. The arrangement of the fourth and second bell crank assemblies 400 and 200 correspond to that of the first and third bell crank assemblies 100 and 300, respectively. There, the other arm 404 or non-aligned arm of the fourth bell crank assembly 400 is connected to the contact position indicator mechanism of the lower circuit breaker 12. The arms 406 and 206 of the fourth and second bell crank assemblies, respectively, are in corresponding vertical and radial alignment.

Each of the aligned arms of the first and third bell crank assemblies and of the second and fourth bell crank assemblies have openings 500 therein for receiving a bell crank assembly interconnecting rod. Intraconnecting rod 510 connects the correspondingly aligned arms 106 and 306 of the first and third bell crank assemblies while intraconnect rod 520 connects the aligned arms 206 and 406 and the second and fourth bell crank assemblies, respectively. Preferably, the ends of these rods 510 and 520 which pass through the openings 500 in the aligned arms of their respective bell crank assemblies are threaded for the purpose of receiving the locking nuts 530.

A pair of trip latch connecting rods are used to attach the interlock mechanism to the trip latch mechanisms of each circuit breaker. Trip latch connecting rod 540 connects the trip latch mechanism of the first circuit breaker 10 and the other or non-aligned arm 204 of the second bell crank assembly 200. The trip latch connecting rod 550 connects the trip latch mechanism of the second circuit breaker 12 with the other or non-aligned arm 304 of the third bell crank assembly 300. The arms 204 and 304 of the second and third bell crank assemblies respectively and the trip latch mechanisms of the upper and lower circuit breakers are provided with openings 500 through which the ends of the connecting rods 540 and 550 pass. Preferably the ends of the rods 540 and 550 are threaded. Locking nuts 530 are threaded onto the ends of the connecting rods 540 and 550 to secure them in place between the arms of their respective bell crank assemblies and the trip latch mechanisms. It will be appreciated that the openings 500 that are provided in the various arms of the interlock mechanism as well as those provided in the trip latch mechanisms have sufficient clearance so that the various connecting rods are not subject to twist or bending during the operation of the interlock mechanism. Additional support can be provided for the connecting rod 540 by positioning it to pass through the auxiliary flange 560 secured to the side of the circuit breaker 10. For connecting rod 550, the auxiliary flange 570 on breaker 12 can be provided for this purpose.

Biasing springs 580 and 590 are provided for the connecting rods 540 and 550, respectively. These biasing springs are used to return the trip latch mechanism to the untripped position. Preferably the biasing springs are coil type springs with the interconnecting rods passing through them. A spring retention collar 582 is provided on rod 540 intermediate the auxiliary flange 560 and the end of the rod 540 connected to the arm 22 of the trip latch mechanism. A set screw or other fastening means is used to adjustably secure the retention collar 582 to the rod 540. Biasing spring 580 is positioned between the collar 582 and the auxiliary flange 560. Adjustment in biasing force is provided by the position of the collar 582 with respect to the auxiliary flange 560. Retention collar 592 and auxiliary flange 570 provide a similar function for circuit breaker 12. In lieu of the auxiliary flanges 560 and 570, the biasing springs 580 and 590 can be positioned between their respective retention collars and the support base 14.

Figure 2:
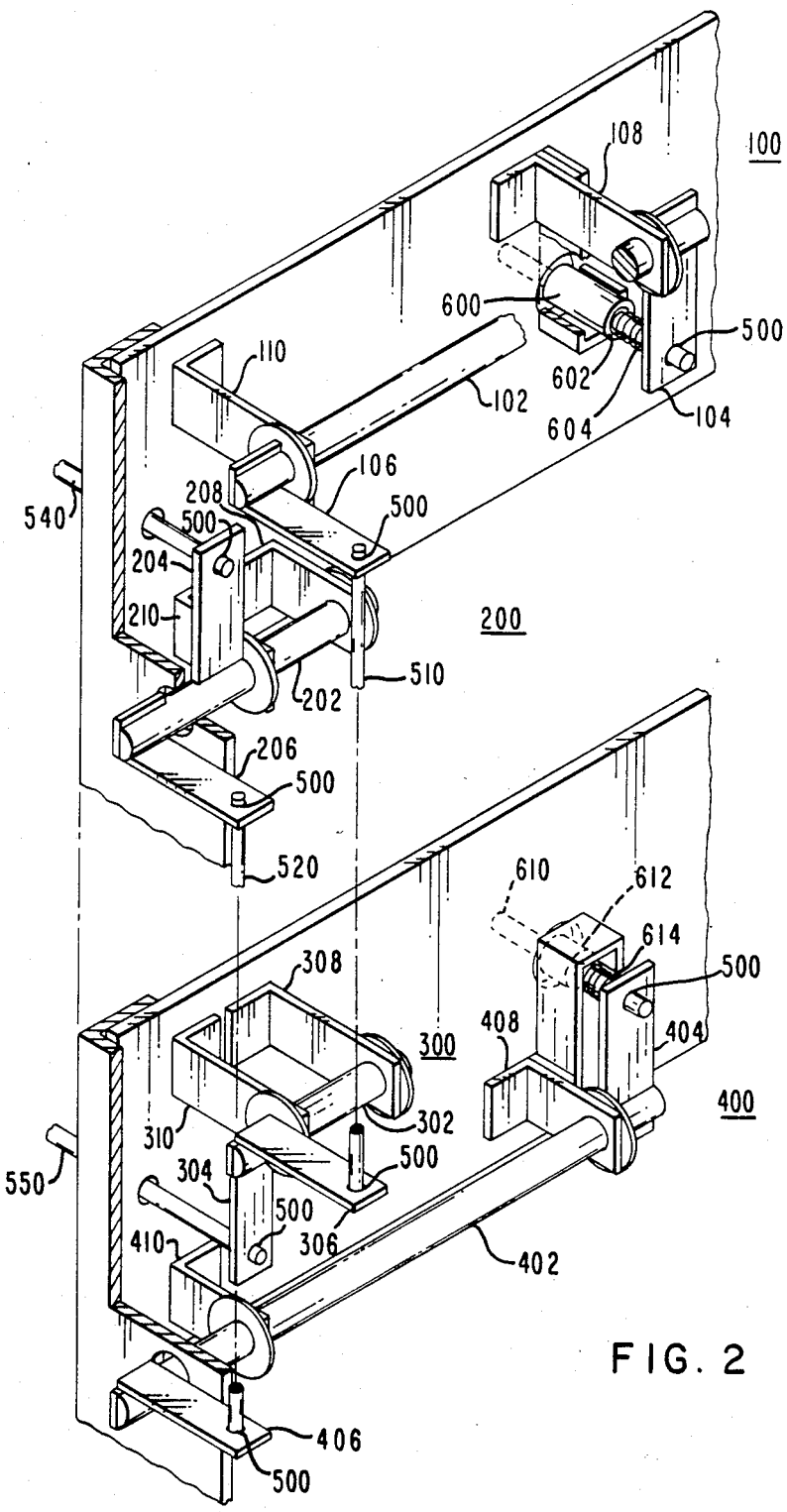
FIG. 2 is an exploded isometric view of the interlock mechanism embodying the invention.

Indicator connecting linkages 600 and 610 are provided intermediate and attached to the arms 104 and 404 of the first and fourth bell crank assemblies, respectively, and abut the contact position indicator mechanisms of circuit breakers 10 and 12. The openings 500 are also provided in the arms 104 and 404. The ends, preferably threaded, of the indicator connecting linkages 104 and 404 pass through these openings and are secured with the locking nuts 530. Spring seats 602 and 612 are provided intermediate the ends of the indicator connecting linkages 600 and 610, respectively. As shown in FIG. 2 the spring seats are enlarged portions of the indicator connecting linkages. Other arrangements such as a collar with a set screw can be used for the same purpose. Biasing spring 604, preferably a compression type spring, is positioned intermediate the spring seat 602 and arm 104 with biasing spring 614 positioned between spring seat 612 and the arm 404. These biasing springs allow for overtravel of the contact position indicators of each of the breakers. For example for circuit breaker 10, on the occurrence of overtravel indicating connecting linkage 600 is pushed further into the opening 500 in the arm 104. This further compresses the spring 604 rather than exerting additional rotational force on the attached bell crank mechanism 100.

Assuming that both the circuits breakers are open, the interlock for the first circuit breaker 10 is actuated on its closing. The contact position indicating mechanism moves to the closed position causing the rotation of the first bell crank assembly 100 via the indicator connecting linkage 600 connected to the indicator connecting linkage. The rotation of the first bell crank assembly 100 moves or lifts the bell crank assembly intraconnecting rod 510 connected thereto that, in turn, rotates the third bell crank assembly 300. This action pulls the trip latch connecting rod 550 that moves the trip latch mechanism of the second circuit breaker 12 to the tripped position via the actuating rod 24 and arm 28. The movement of the connecting rod 550 compresses the trip latch biasing spring bias 590. While in the tripped position the second circuit breaker 12 cannot be closed. Upon opening of the first circuit breaker 10, the contact position indicator mechanism thereof moves to the open position and no longer drives against the indicator connecting linkage 600. The biasing spring 604 pushes the connecting linkage 600 to maintain its contact with contact position indicator mechanism as it transfers back to the open position. At this point the biasing spring 590 moves the trip latch mechanism of the second circuit breaker 12 back to the untripped position allowing the second circuit breaker 12 to be closed if desired. The interlock for the second circuit breaker functions in substantially the same manner with the first circuit breaker via the fourth and second bell crank assemblies and connecting rods. With this arrangement only one of the two circuit breakers can be closed at any one time.

Preferably, an insulated mounting surface is provided adjacent each of the circuit breakers on the support base for mounting the interlock mechanism. With this mounting arrangement only two connections into each of the circuit breakers are required via the indicator connecting linkage and the trip latch connecting rod. Also the locking nuts which are attached to the bell crank inteconnecting rods and the trip latch connecting rods are used for adjusting the length of these rods between their various connection points. This is a means for adjusting of the slack or play in the various linkages of the interlock mechanism. The nuts are self-locking in order to prevent them from loosening and changing position due to vibration from breaker operations and movement operation of the interlock mechanism. It should also be realized that the placement of the support brackets of each bell crank assembly and length of the various rods and linkages is determined as a matter of mounting convenience with various obvious modifications being possible without affecting the operation of the interlock mechanism.

Other embodiments of the invention will be apparent to those skilled in the art from a consideration of this specification or practice of the invention disclosed herein. It is intended that the specification be considered as exemplary only with the true scope and spirit of the invention being indicated by the following claims.

I claim:

1. An interlock mechanism for preventing a pair of vertically mounted circuit breakers from being concurrently closed, each circuit breaker including a trip latch means operable between tripped and untripped positions that when tripped opens the circuit breaker when closed and prevents closing thereof and when untripped allows the circuit breaker when open to be closed, and a contact position indicator means for providing mechanical indication of the open position and the closed position of the circuit breaker, comprising:

a first bell crank assembly;

a second bell crank assembly;

a third bell crank assembly;

a fourth bell crank assembly, the first and second bell crank assemblies mounted adjacent the first circuit breaker with the third and fourth bell crank assemblies mounted adjacent to the second circuit breaker, the first and third bell crank assemblies being substantially parallel to one another and having one arm of each being in corresponding radial and vertical alignment with the other arm of the first bell crank assembly connected to the contact position indicator means of the first circuit breaker, the arrangement of the fourth bell crank assembly on the second circuit breaker and that of the second bell crank assembly being substantially similar to that of the first and third bell crank assemblies, respectively;

a pair of bell crank assembly intraconnecting means, one bell crank assembly intraconnecting means connecting correspondingly aligned arms of the first and third bell crank assemblies and the second and fourth bell crank assemblies, respectively;

a pair of trip latch connecting means, one trip latch connecting means connected to the trip latch means of the first circuit breaker and the other arm on the second bell crank assembly with the other trip latch connecting means connected to the trip latch means of the second circuit breaker and the other arm on the third bell crank assembly; and trip latch spring biasing means for returning each trip latch means to the untripped position, the interlock for the first circuit breaker being actuated by the contact position indicating means thereof moving to the closed position causing the rotation of the first bell crank assembly via the arm thereof connected to the contact position indicating means, the rotation of the first bell crank assembly moving the bell crank assembly intraconnecting means connected thereto that in turn rotates the third bell crank assembly connected thereto moving the trip latch connecting means that moves the trip latch means of the second circuit breaker to the tripped position preventing the second circuit breaker from closing and upon opening of the first circuit breaker the trip latch spring biasing means moving the trip latch means of the second circuit breaker back to the untripped position allowing the second circuit breaker to be closed, the interlock for the second circuit breaker functioning in substantially the same manner with the first circuit breaker via the fourth and second bell crank assemblies thereby allowing only one of the two circuit breakers to be closed at any time.

2. The interlock mechanism of claim 1 wherein each bell crank assembly further comprises:

a rod having two axially offset radial arms positioned substantially perpendicular with respect to each other;

bracket means for supporting the rod and allowing the rotation thereof about an axis defined by center line through the length of the rod; and fastening means for mounting the bracket means.

3. The interlock mechanism of claim 1 further comprising means for adjusting the length of each bell crank assembly intraconnecting means between the aligned arms of each bell crank assembly connected thereto.

4. The interlock mechanism of claim 1 further comprising means for adjusting the length of the trip latch connecting means between the trip latch means and the bell crank assembly connected thereto.

5. The interlock mechanism of claim 1 further comprising:

a pair of indicator connecting linkages, one linkage connecting the mechanical contact position indicating means of the first circuit breaker and the other arm on the first bell crank assembly with the other linkage connecting the mechanical contact position indicating means of the second circuit breaker and the other arm on the fourth bell crank assembly; and indicator connecting linkage spring biasing means for each indicator connecting linkage allowing for the overtravel of the contact position indicating means with respect to the bell crank assembly connected thereto.

6. An interlock mechanism for preventing a pair of vertically mounted circuit breakers from being concurrently closed, each circuit breaker including a trip latch means operable between tripped and untripped positions that when tripped opens the circuit breaker when closed and prevents closing thereof and when untripped allows the circuit breaker when open to be closed, and a contact position indicator means for providing mechanical indication of the open position and the closed position of the circuit breaker, comprising:

first bell crank assembly;

second bell crank assemby;

third bell crank assembly;

fourth bell crank assembly, each bell crank assembly including:

a rod having two axially offset radial arms positioned substantially perpendicular with respect to each other;

bracket means for supporting the rod and allowing the rotation thereof about an axis defined by center line through the length of the rod, the first and second bell crank assemblies mounted adjacent the first circuit breaker with the third and fourth bell crank assemblies mounted adjacent to the second circuit breaker, the rods of the first and third bell crank assemblies being substantially parallel to one another and having one arm of each being in corresponding radial and vertical alignment with the other arm of the first bell crank assembly connected to the contact position indicator means, the arrangement of the fourth and second bell crank assemblies being substantially similar to that of the first and third bell crank assemblies, respectively;

a pair of bell crank assembly intraconnecting rods, one intraconnecting rod connecting correspondingly aligned arms of the first and third bell crank assemblies and the second and fourth bell crank assemblies, respectively;

a pair of trip latch connecting rods, one trip latch connecting rod connected to the trip latch means of the first circuit breaker and the other arm of the second bell crank assembly with the other trip latch connecting rod connected to the trip latch means of the second circuit breaker and the other arm on the third bell crank assembly; and trip latch spring biasing means for returning each trip latch means to the untripped position, the interlock for the first circuit breaker being actuated by the contact position indicating means thereof moving to the closed position causing the rotation of the first bell crank assembly via the arm thereof connected to the contact position indicating means, the rotation of the first bell crank assembly moving the bell crank assembly intraconnecting rod connected thereto that in turn rotates the third bell crank assembly connected thereto moving the trip latch connecting rod that moves the trip latch means of the second circuit breaker to the tripped position preventing the second circuit breaker from closing and upon opening of the first circuit breaker the trip latch spring biasing means moving the trip latch means of the second circuit breaker back to the untripped position allowing the second circuit breaker to be closed, the interlock for the second circuit breaker functioning in substantially the same manner with the first circuit breaker via the fourth and second bell crank assemblies thereby allowing only one of the two circuit breakers to be closed at any time.

7. An interlock mechanism for preventing a pair of vertically mounted circuit breakers for being concurrently closed, each circuit breaker including a trip latch means operable between tripped and untripped positions that when tripped opens the circuit breaker when closed and prevents closing thereof and when untripped allows the circuit breaker when open to be closed, and a contact position indicator means for providing mechanical indication of the open position and the closed position of the circuit breaker, comprising:

a first electrically insulated mounting surface provided adjacent one circuit breaker;

a second electrically insulated mounting surface provided adjacent the other circuit breaker;

first bell crank assembly;

second bell crank assembly;

third bell crank assembly;

fourth bell crank assembly, each bell crank assembly including:

a rod having two axially offset radial arms positioned substantially perpendicular with respect to each other;

support bracket means for supporting the rod and allowing the rotation thereof about an axis defined by center line through the length of the rod, fastening means for attaching the bell crank assembly to the mounting surface, the first and second bell crank assemblies attached to the first mounting surface with the third and fourth bell crank assemblies attached to the second mounting surface, the rods of the first and third bell crank assemblies being substantially parallel to one another and having one arm of each being in corresponding radial and vertical alignment with the arrangement of the fourth and second bell crank assemblies being substantially similar to that of the first and third bell crank assemblies, respectively;

a pair of bell crank assembly intraconnecting rods, one intraconnecting rod connecting correspondingly aligned arms of the first and third bell crank assemblies and the second and fourth bell crank assemblies, respectively;

bell crank assembly intraconnecting rod adjusting means for controlling the length of each intraconnecting rod between the aligned arms of each bell crank assembly connected thereto;

a pair of trip latch connecting rods, one trip latch connecting rod connected to the trip latch means of the first circuit breaker and the other arm of the second bell crank assembly with the other trip latch connecting rod connected to the trip latch means of the second circuit breaker and the other arm on the third bell crank assembly;

trip latch spring biasing means for returning each trip latch means to the untripped position, a pair of indicator connecting linkages, one linkage connecting the mechanical contact position indicating means of the first circuit breaker with the other arm on the first bell crank assembly with the other linkage connecting the mechanical contact position indicating means of the second circuit breaker with the other arm on the fourth bell crank assembly; and indicator connecting linkage spring biasing means for each indicator connecting linkage allowing for overtravel of the contact position indicating means with respect to the bell crank assembly connected thereto, the interlock for the first circuit breaker being actuated by the contact position indicating means thereof moving to the closed position causing the rotation of the first bell crank assembly via the arm thereof connected to the contact position indicating means, the rotation of the first bell crank assembly moving the bell crank assembly intraconnecting rod connected thereto that in turn rotates the third bell crank assembly connected thereto moving the trip latch connecting rod that moves thr trip latch means of the second circuit breaker to the tripped position preventing the second circuit breaker from closing and upon opening of the first circuit breaker the trip latch spring biasing means moving the trip latch means of the second circuit breaker back to the untripped position allowing the second circuit breaker to be closed, the interlock for the second circuit breaker functioning in substantially the same manner with the first circuit breaker via the fourth and second bell crank assemblies thereby allowing only one of the two circuit breakers to be closed at any time.

* * * * *